US006619998B1

(12) United States Patent
Kuo

(10) Patent No.: US 6,619,998 B1
(45) Date of Patent: Sep. 16, 2003

(54) TERMINAL-MOUNTING SEAT ADAPTED TO BE MOUNTED ON A PRINTED CIRCUIT BOARD

(75) Inventor: Yung-Ming Kuo, Taichung Hsien (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 10/166,212

(22) Filed: Jun. 10, 2002

(51) Int. Cl.[7] ..... H01R 13/40
(52) U.S. Cl. ..... 439/712; 439/596
(58) Field of Search ..... 439/596, 709, 439/712, 713

(56) References Cited

U.S. PATENT DOCUMENTS 4,505,533 A * 3/1985 Nicolaisen ..... 439/712
4,602,841 A * 7/1986 Pohl ..... 439/404
6,000,967 A * 12/1999 Norizuki et al. ..... 439/596
6,024,605 A * 2/2000 Beck et al. ..... 439/595

* cited by examiner

*Primary Examiner*—Gary Paumen
*Assistant Examiner*—James R. Harvey
(74) *Attorney, Agent, or Firm*—Ladas & Parry

(57) ABSTRACT

A terminal-mounting seat includes an insulated housing having left and right walls defining a bottom opening. A bottom cover is disposed below the housing for covering the bottom opening. A flexible connecting strip is interposed between and is integrally connected to the bottom cover and the right wall so as to permit turning of the bottom cover relative to the right wall to an open position, in which the bottom opening is exposed so as to facilitate replacement of terminals in the housing.

2 Claims, 5 Drawing Sheets

TERMINAL-MOUNTING SEAT ADAPTED TO BE MOUNTED ON A PRINTED CIRCUIT BOARD

BACKGROUND OF THE INVENTION

1. Field of the Invention

The present invention relates to a terminal-mounting seat, more particularly to a terminal-mounting seat that is adapted to be mounted on a printed circuit board.

2. Description of the Related Art

Referring to FIGS. 1 and 2, a conventional terminal-mounting seat is adapted to be mounted on a printed circuit board for receiving conductive terminals 5 therein, and is shown to include an insulated housing 1, two insulated terminal-holding blocks 3, two fastener bolts 4, and an insulated bottom cover 2.

As illustrated, the housing 1 defines a receiving space 108, and has a roof 100, a bottom opening 104 opposite to the roof 100, and a vertical rear wall 109 that extends downwardly from the roof 100 to confine a rear side of the receiving space 108. A partition (not visible) is disposed in the receiving space 108 to divide the same into two isolated compartments 102. The roof 100 includes a first roof part 107 extending from the rear wall 109 and formed with two upper opening 103, each of which extends in a first direction and is in spatial communication with the respective compartment 102, a second roof part 106 extending from and angled away from the first roof part 107, and formed with two bolt-retention bores 101, each of which extends in a second direction perpendicular to the first direction and is in spatial communication with the respective compartment 102.

Each of the terminal-holding blocks 3 is mounted in the respective compartment 102, and is formed with a terminal channel 302 that extends in the first direction, that is in spatial communication with the respective upper opening 103, and that receives a first terminal section 501 of a respective one of the terminals 5 therein, and a threaded hole 301 that extends in the second direction and that is in spatial communication with the terminal channel 302 and the bore 101.

Each of the fastener bolts 4 extends through the respective one of the bolt-retention bores 101, and threadedly engages the threaded hole 301 in a respective terminal-holding block 3.

The bottom cover 2 is disposed below the housing 1 for covering the bottom opening 104, and is formed with two terminal through-holes 201, each of which is in spatial communication with the terminal channel 302 of the respective terminal-holding block 3 via the respective compartment 102 and permits passage of a second terminal section 502 of the respective terminal 5 therethrough.

One disadvantage of the aforementioned conventional terminal-mounting seat resides in that since the bottom cover 2 is welded to a periphery of the bottom opening 104 in the housing 1 after mounting of the blocks 3 and the terminals 5 in the housing 1, the manufacturing cost is relatively high. In case, the terminal 5 is broken, replacement thereof is also inconvenient.

SUMMARY OF THE INVENTION

Therefore, the object of this invention is to provide a terminal-mounting seat which eliminate the aforementioned drawback of the prior art.

Another object of the present invention is to provide a terminal-mounting seat which facilitates replacement of terminals.

Accordingly, a terminal-mounting seat of the present invention is adapted to be mounted on a printed circuit board for receiving a conductive terminal that has a first terminal section and a second terminal section angled away from the first terminal section. The terminal-mounting seat includes an insulated housing, an insulated terminal-holding block, a fastener bolt, a flexible insulated connecting strip, and an insulated bottom cover. The housing has spaced apart vertical left and right walls, a roof interconnecting and cooperating with the left and right walls to define a receiving space thereamong, and a bottom opening opposite to the roof. The roof has a first roof part extending from the left wall and formed with a bolt-retention bore that extends in a first direction and that is in spatial communication with the receiving space, and a second roof part extending from the right wall, connected to and angled away from the first roof part, and formed with an upper opening that extends in a second direction perpendicular to the first direction and that is in spatial communication with the receiving space. Each of the left and right walls has a bottom end. The terminal-holding block is mounted in the receiving space, and is formed with a terminal channel that extends in the second direction, that is in spatial communication with the upper opening, and that is adapted to receive the first terminal section therein, and a threaded hole that extends in the first direction and that is in spatial communication with the terminal channel and the bore. The fastener bolt extends through the bolt-retention bore, and threadedly engages the threaded hole in the terminal-holding block. The flexible connecting strip has a first end integrally connected to the bottom end of the right wall and a second end that is opposite to the first end. The bottom cover is disposed below the housing, is formed with a terminal through-hole, and has a first end and a second end that is opposite to the first end and that is integrally connected to the second end of the connecting strip so as to permit turning of the bottom cover relative to the right wall between an open position, in which the bottom opening is exposed to permit insertion of the terminal-holding block therethrough and into the receiving space, and a closed position, in which the bottom cover covers the bottom opening, and the first end detachably engages the bottom end of the left wall. The terminal through-hole is in spatial communication with the terminal channel via the receiving space, and is adapted to permit passage of the second terminal section therethrough when the bottom cover is positioned at the closed position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
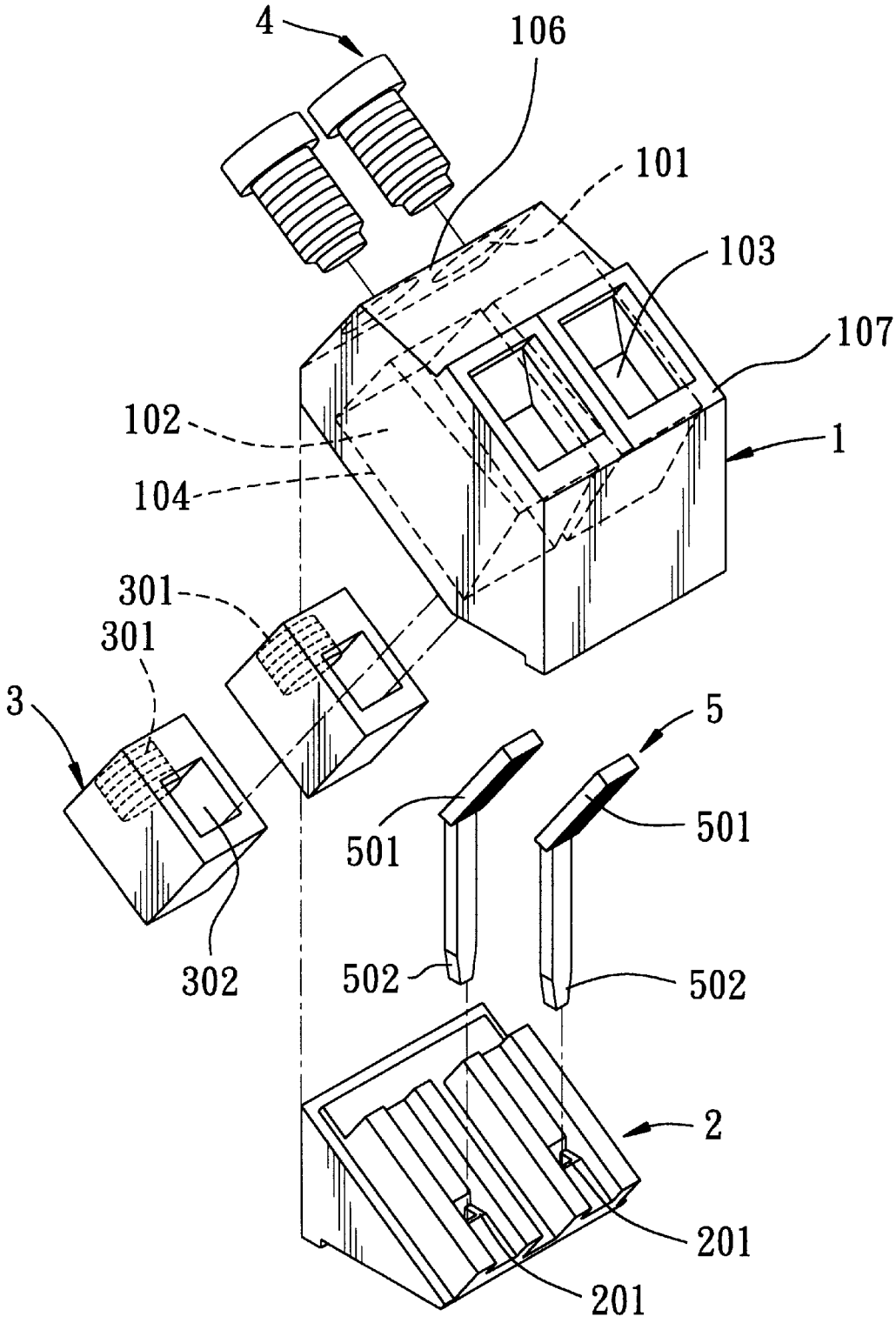
FIG. 1 PRIOR ART
FIG. 1 is an exploded perspective view of a conventional terminal-mounting seat that is adapted to be mounted on a printed circuit board.
Figure 2:
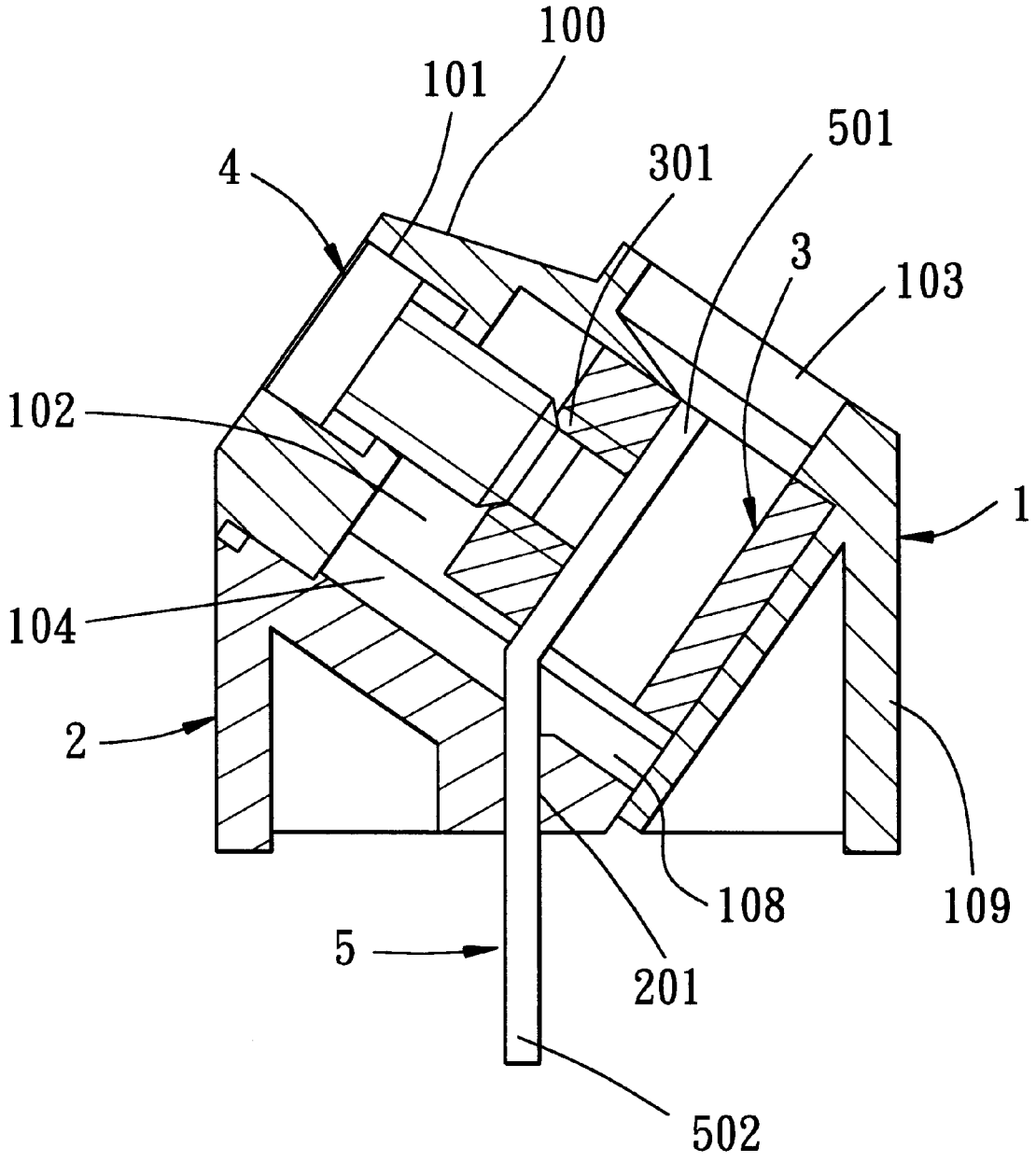
FIG. 2 PRIOR ART
FIG. 2 is a sectional view of the conventional terminal-mounting seat shown in FIG. 1.
Figure 3:
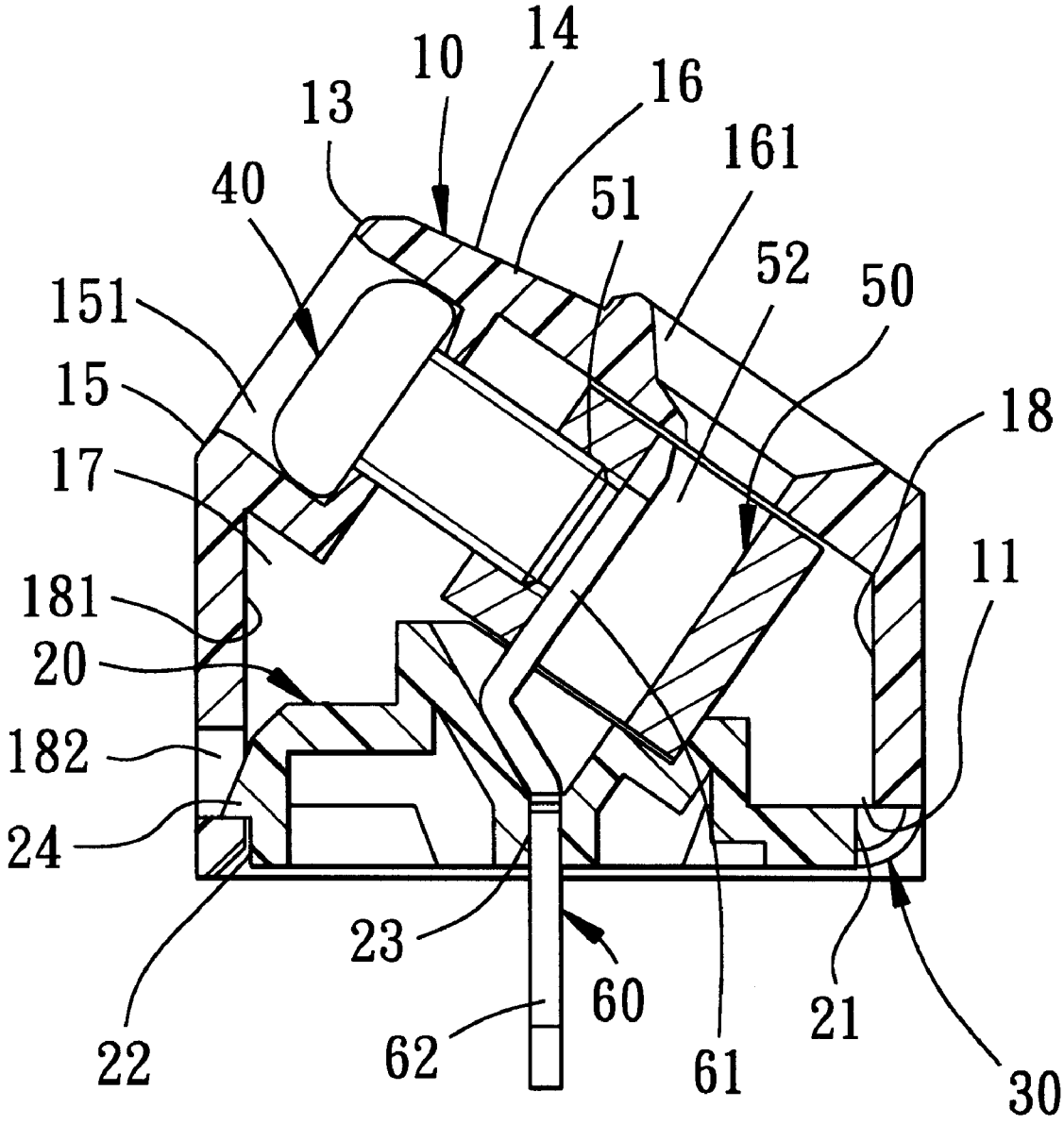
FIG. 3 is a sectional view of a preferred embodiment of a terminal-mounting seat according to the present invention.
Figure 4:
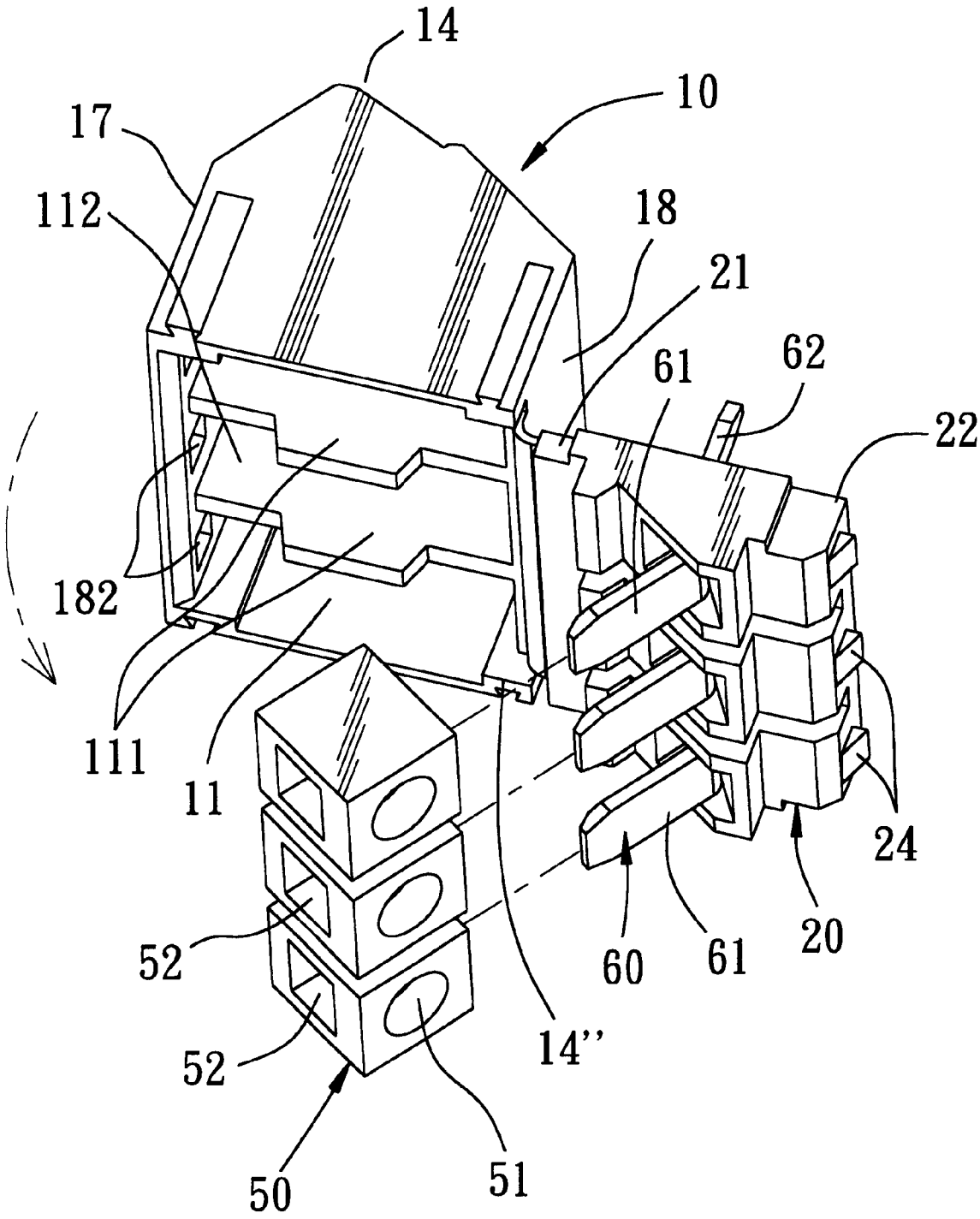
FIG. 4 is an exploded perspective view of the preferred embodiment shown in FIG. 3.
Figure 5:
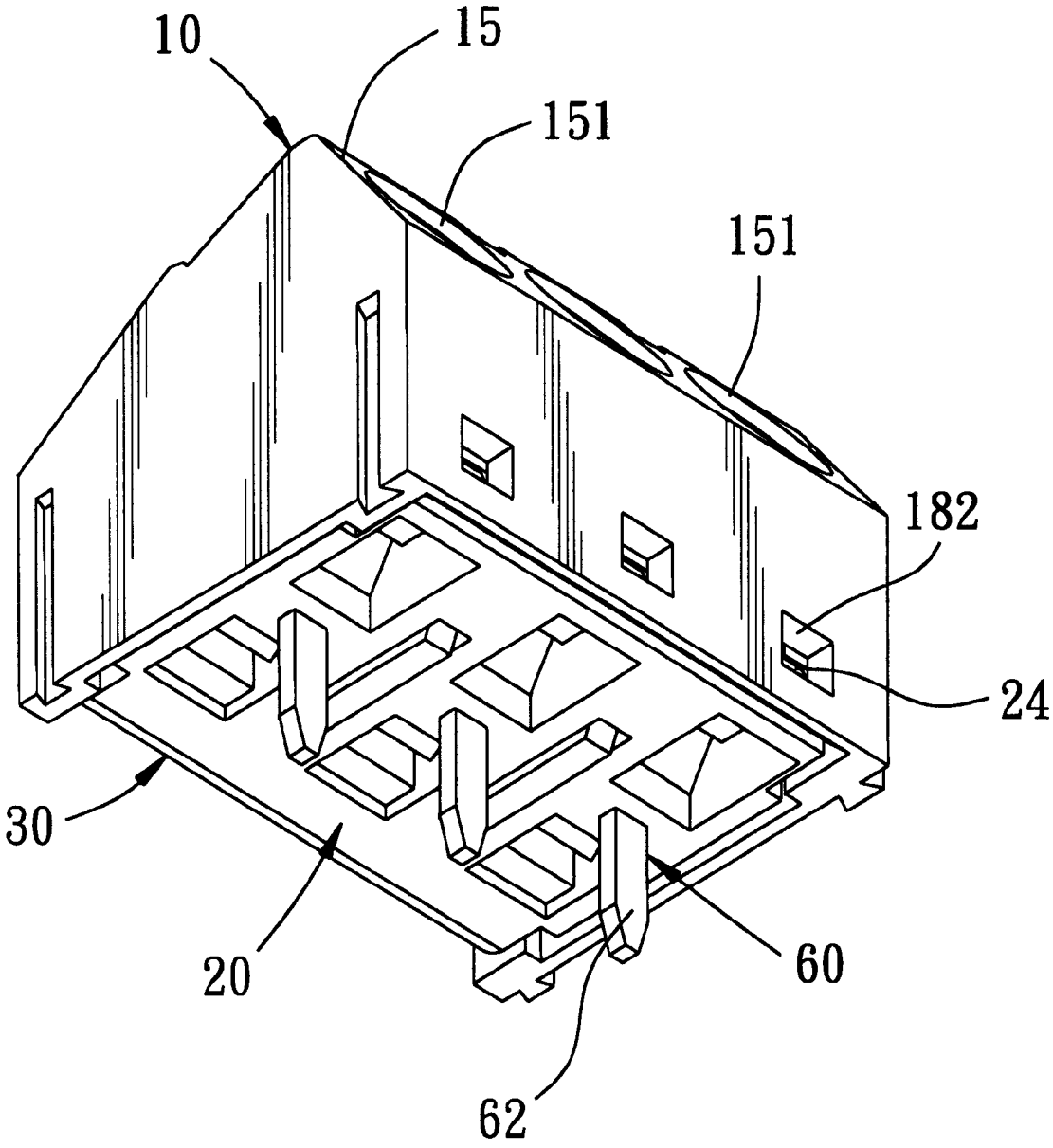
FIG. 5 is a perspective bottom view of the preferred embodiment.

Referring to FIGS. 3 to 5, the preferred embodiment of a terminal-mounting seat according to the present invention is adapted to be mounted on a printed circuit board (not shown) for receiving three conductive terminals 60, each of which has a first terminal section 61 and a second terminal section 62 angled away from the first terminal section 61. The preferred embodiment is shown to include an insulated housing 10, three insulated terminal-holding blocks 50, three fastener bolts 40 (only one is visible in FIG. 3), a flexible insulated connecting strip 30, and an insulated bottom cover 20.

As illustrated, the housing 10 is made from am insulating material, such as plastics and rubber, and has spaced apart vertical left and right walls 17, 18, a roof 14 interconnecting and cooperating with the left and right walls 17, 18 to define a receiving space 11 thereamong, and a bottom opening 14" opposite to the roof 14. Two partitions 111 are disposed in the receiving space 11 to form three separate compartments 112 in the receiving space 11. The roof 14 has a first roof part 15 extending from the left wall 17, and is formed with a bolt-retention bore 151 that extends in a first direction and that is in spatial communication with a respective one of the compartments 112, and a second roof part 16 that extends from the right wall 18, that cooperates with the first roof part 15 to define a roof apex 13 therebetween, that is connected to and angled away from the first roof part 15, and that is formed with an upper opening 161 extending in a second direction perpendicular to the first direction and in spatial communication with a respective one of the compartments 112. Each of the left and right walls 17, 18 has a bottom end.

Each of the terminal-holding blocks 50 is made from the same insulating material as that of the housing 10, is mounted in a respective one of the compartments 112, and is formed with a terminal channel 52 that extends in the second direction, that is in spatial communication with the upper opening 161, and that receives the first terminal section 61 of a respective one of the terminals 60 therein, and a threaded hole 151 that extends in the first direction and that is in spatial communication with the terminal channel 52 and the bore 151.

Each of the fastener bolts 40 extends through a respective bolt-retention bore 151, and threadedly engages the threaded hole 151 in a respective one of the terminal-holding blocks 50.

The flexible connecting strip 30 has a first end integrally connected to the bottom end of the right wall 18, and a second end that is opposite to the first end.

The bottom cover 20 is disposed below the housing 10, is formed with three terminal through-holes 23, and has a first end 22 and a second end 21 that is opposite to the first end 22 and that is integrally connected to the second end of the connecting strip 30 so as to permit turning of the bottom cover 20 relative to the right wall 18 between an open position, as best shown in FIG. 4, in which the bottom opening 14" is exposed to permit insertion of the terminal-holding blocks 50 therethrough and into the respective compartments 112, and a closed position, as best shown in FIG. 3, in which the bottom cover 20 covers the bottom opening 14" and the first end 22 of the bottom cover 20 detachably engages the bottom end of the left wall 17. Each of the terminal through-holes 23 is in spatial communication with the terminal channel 52 of the respective terminal-holding block 50 via the respective compartment 112, and permits passage of the second terminal section 62 of the respective terminal 60 therethrough when the bottom cover 20 is positioned at the closed position.

The preferred embodiment further includes a tongue-and-groove device interposed between the left wall 17 and the first end 22 of the bottom cover 20 for releasably fastening the bottom cover 20 to the bottom end of the left wall 17. Preferably, the tongue-and-groove device has three spaced apart engaging grooves 182 formed in the left wall 17 adjacent to the bottom end thereof, and three engagement tongues 24 formed on the first end 22 of the bottom cover 20 for detachably engaging the grooves 182 when the bottom cover 20 is at the closed position.

By virtue of the conditions of the present invention, assembly of the terminal-mounting seat is convenient. Moreover, since the flexible connecting strip 30 permits turning of the bottom cover 20 to the open position, replacement of the terminal 60 is convenient.

With this invention thus explained, it is apparent that numerous modifications and variations can be made without departing from the scope and spirit of this invention. It is therefore intended that the invention be limited only as indicated in the appended claims.

I claim:

1. A terminal-mounting seat adapted to be mounted on a printed circuit board for receiving a conductive terminal that has a first terminal section and a second terminal section angled away from said first terminal section, said terminal-mounting seat comprising:

an insulated housing having spaced apart vertical left and right walls, a roof interconnecting and cooperating with said left and right walls to define a receiving space thereamong, and a bottom opening opposite to said roof, said roof having a first roof part extending from said a left wall and formed with a bolt-retention bore that extends in a first direction and that is in spatial communication with said receiving space, and a second roof part extending from said right wall, connected to and angled away from said first roof part, and formed with an upper opening that extends in a second direction perpendicular to said first direction and that is in spatial communication with said receiving space, each of said left and right walls having a bottom end;

an insulated terminal-holding block mounted in said receiving space and formed with a terminal channel that extends in said second direction, that is in spatial communication with said upper opening, and that is adapted to receive the first terminal section therein, and a threaded hole that extends in said first direction and that is in spatial communication with said terminal channel and said bore;

a fastener bolt extending through said bolt-retention bore and threadedly engaging said threaded hole in said terminal-holding block;

a flexible insulated connecting strip having a first end integrally connected to said bottom end of said right wall and a second end that is opposite to said first end; and an insulated bottom cover disposed below said housing, formed with a terminal through-hole, and having a first end and a second end that is opposite to said first end and that is integrally connected to said second end of said connecting strip so as to permit turning of said bottom cover relative to said right wall between an open position, in which said bottom opening is exposed to permit insertion of said terminal-holding block therethrough and into said receiving space, and a closed position, in which said bottom cover covers said bottom opening, and said first end detachably engages said bottom end of said left wall, said terminal through-hole being in spatial communication with said terminal channel via said receiving space and being adapted to permit passage of the second terminal section therethrough when said bottom cover is positioned at said closed position.

2. The terminal-mounting seat as defined in claim 1, further comprising a tongue-and-groove device interposed between said left wall and said first end of said bottom cover for releasably fastening said bottom cover to said bottom end of said left wall.

* * * * *